US007481621B2

(12) United States Patent
Campbell et al.

(10) Patent No.: US 7,481,621 B2
(45) Date of Patent: Jan. 27, 2009

(54) AIRFOIL WITH HEATING SOURCE

(75) Inventors: Christian X. Campbell, Orlando, FL (US); Bonnie D. Marini, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 378 days.

(21) Appl. No.: 11/315,852

(22) Filed: Dec. 22, 2005

(65) Prior Publication Data

US 2007/0147996 A1 Jun. 28, 2007

(51) Int. Cl.
*F01D 5/08* (2006.01)

(52) U.S. Cl. ..... 416/96 R; 416/241 B; 415/115; 415/116

(58) Field of Classification Search ..... 416/95, 416/96 R, 241 B, 229 R, 229 A; 415/115, 415/176, 177, 114, 116
See application file for complete search history.

(56) References Cited

U.S. PATENT DOCUMENTS 6,027,078 A * 2/2000 Crouch et al. ..... 244/204
6,451,416 B1 * 9/2002 Holowczak et al. ..... 428/293.4
6,709,230 B2 3/2004 Morrison et al.
6,733,907 B2 5/2004 Morrison et al.
6,746,755 B2 6/2004 Morrison et al.
6,767,659 B1 7/2004 Campbell
7,217,088 B2 * 5/2007 Albrecht et al. ..... 415/115
2004/0043889 A1 3/2004 Campbell

* cited by examiner

*Primary Examiner*—Ninh H Nguyen

(57) ABSTRACT

An airfoil (26) for a gas turbine engine (10) having a source of heat for controlling a temperature gradient across the airfoil components. In one embodiment the airfoil includes a CMC outer body (28) defining an airfoil shape and a ceramic inner body core member (36) housed within and bonded to the outer body, and a heating element (54) disposed within the inner body core member. In another embodiment the source of heat may include a conduit (55) for delivering a flow of hot combustion gas from the combustor (14) to an interior of the airfoil. Heat energy may be delivered to the airfoil interior prior to or during startup of the engine in order to reduce the effect of temperature transients, during ongoing operation of the engine to reduce steady state temperature gradients, and/or during shutdown conditions to mitigate differential shrinkage between the core member and the outer body of the airfoil.

24 Claims, 2 Drawing Sheets

AIRFOIL WITH HEATING SOURCE

FIELD OF THE INVENTION

The subject matter described herein relates generally to gas turbine engines, and more specifically, to an airfoil construction comprising a ceramic matrix composite material and which provides for reduced stress within that construction.

BACKGROUND OF THE INVENTION

Airfoils and the composition of materials from which they are formed are a continuing source of study, examples of which are provided in U.S. Pat. No. 6,709,230 B2 and U.S. Patent Application Publication No. 2004/0043889 A1; each of which is incorporated by reference herein.

With reference to U.S. Pat. No. 6,709,230 B2, there is provided a stationary vane comprising an airfoil structure that, in turn, comprises multiple components such as an outer surface member and a core member bonded together, and whereby each member has a different structural composition. In particular, the outer surface member comprises a body of ceramic matrix composite (hereinafter "CMC") material, the details and advantages of which are explained therein. The core member comprises a body of monolithic ceramic material as opposed to a composite thereof. As will be understood by one of ordinary skill in the art, a primary difference in the composition of a CMC versus a more monolithic ceramic is that the CMC is constructed with the use of fibers for the purpose of reinforcing the overall strength thereof given use in high load environments. In contrast, a non-composite ceramic is constructed without the inclusion of such fibers.

Airfoils of all designs that are used in gas turbine engines are subjected to a wide range of temperatures and temperature transient conditions. Airfoil designs must be tolerant to stresses induced within the airfoil as a result of such temperatures.

BRIEF DESCRIPTION OF THE DRAWINGS

The invention is explained in following description in view of the drawings wherein:

FIG. 3 is a cross-sectional view of a portion of the ceramic inner body core member of a solid core airfoil illustrating an opening for conveying hot gas extending there through.

DETAILED DESCRIPTION OF THE INVENTION

With reference to airfoil construction like that shown in the aforementioned patent, it has been observed that during various stages of operation of an engine with which a hybrid construction airfoil is associated, such construction often undergoes large magnitudes of tensile stress. This stress results from the temperature differential experienced between the outer surface member and the core member, inclusive of the bond there between, as the outer surface member becomes heated to a higher temperature than the core member. When the core member remains cooler than the outer surface member, there is a tendency for the outer member to grow away from the core member, thereby creating a tensile stress in the bond between the members and an interlaminar tensile stress within the CMC material forming the outer member.

Figure 1:
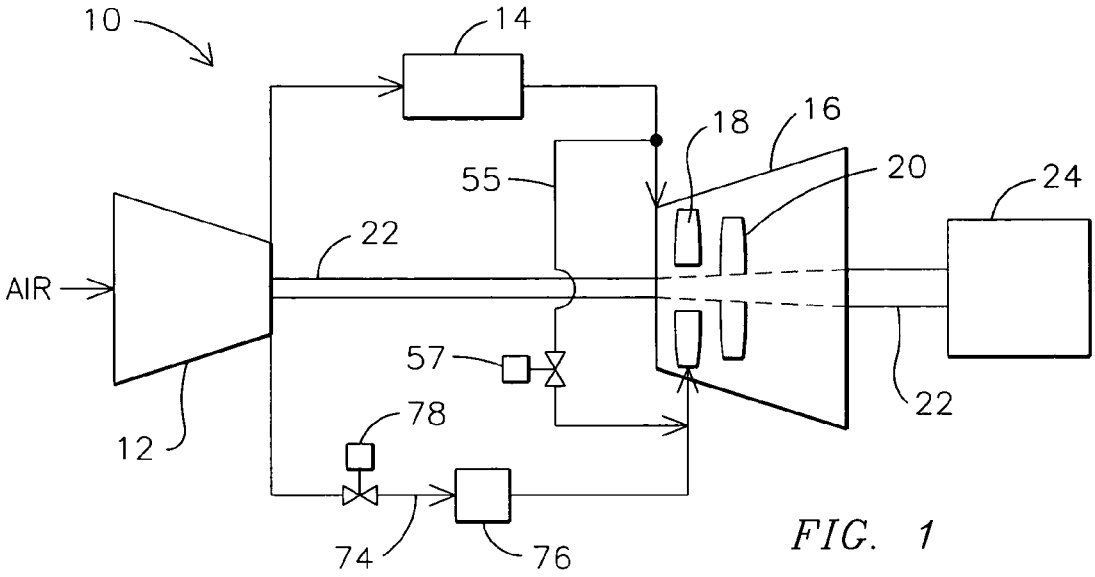
FIG. 1 is a schematic diagram illustrating a gas turbine engine system incorporating a source of heat for controlling a temperature interior to a stationary vane of the gas turbine.

In looking to FIG. 1, there is provided an illustration of a gas turbine engine system including an airfoil construction incorporating a heat delivery source for controlling the temperature differential across the airfoil structure and thereby for controlling stresses generated within the airfoil. With continuing reference to FIG. 1, there is provided a gas turbine engine system 10 for the production of energy. Air is introduced into a compressor 12 that, in turn, provides compressed air to a combustor 14. In the combustor 14, fuel is combusted in the compressed air so as to raise the operating temperature thereof and to provide for its conversion into hot combustion gas. This hot combustion gas is then fed to a turbine 16 having a plurality of stationary and rotating airfoils 18 and 20, respectively, for the expansion and cooling of the combustion gas and the extraction of energy in the form of shaft power. The shaft 22 may connect the compressor 12 and the turbine 16 to a generator 24 so as to enable the production of electrical energy in a manner well understood in the art.

In reference to the plurality of airfoils mentioned above, and as will be understood by one of ordinary skill in the art, the stationary and moveable airfoils 18, 20 are configured in an alternating sequence within the turbine 16. Such alternating sequence enables the hot combustion gas to be moved there through with increased efficiency. Further, it is to be understood that the stationary airfoils 18 that comprise a focus of the discussion herein are generally referred to as vanes, and they serve to direct a flow of the combustion gas toward a moving blade 20 positioned downstream thereof.

Figure 2:
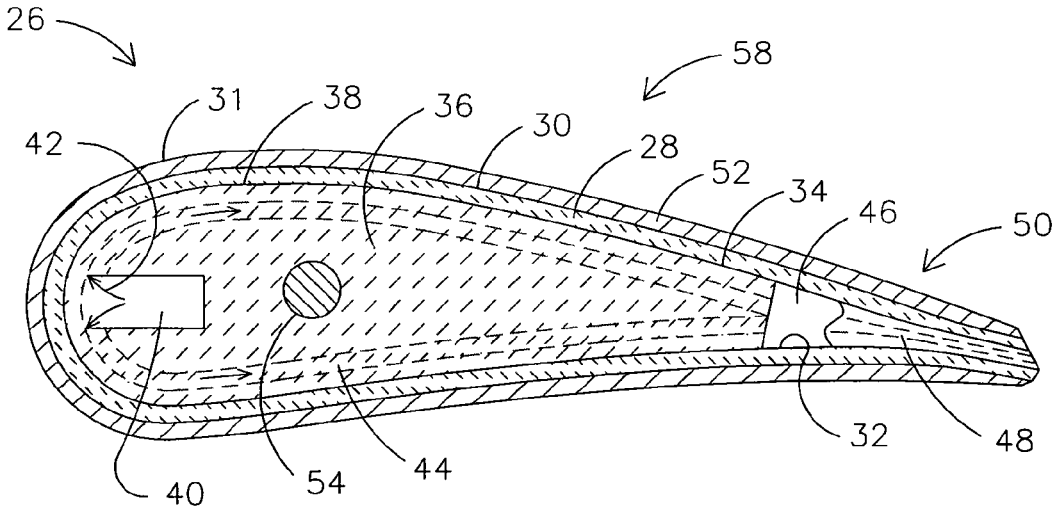
FIG. 2 is a cross-sectional view of a solid-core ceramic matrix composite gas turbine airfoil comprising a CMC outer surface and a ceramic inner body core member having a heat-producing component disposed within the core member.

Now looking to FIG. 2, there is provided a hybrid construction airfoil 26 that is exemplary of the type of airfoil optionally to be provided in the system 10 of FIG. 1. Such an airfoil 26 comprises an outer body 28 comprising an outer surface 30 defining an airfoil shape. Opposite the outer surface 30 is an inner surface 32 defining a core region 34 of the airfoil 26. Within the core region 34, there is disposed a substantially solid inner body core member 36 that is associated with the inner surface 32 by a bond 38. As further shown in FIG. 2, the inner body core member 36 may comprise a plenum 40 for the introduction of a cooling fluid 42 for circulation within a plurality of cooling channels 44. The cooling fluid 42 operates to cool the outer body 28. The cooling channels 44 may be disposed within the outer body CMC member, between the CMC member and the core member, or within the core member proximate the CMC member. An outlet plenum 46 is provided and which serves to redistribute the cooling fluid 42 to a second plurality of cooling passages 48 formed proximate a trailing edge 50. The outer surface 30 may be exposed directly to hot combustion gas passing over the airfoil 26, or optionally the airfoil 26 may further comprise a layer of insulation 52 disposed upon the outer surface 28 which defines a further outer surface 31 exposed directly to the hot combustion gas. The airfoil 26 also include a heating element 54 disposed with the core member 36, the operation and advantages of which are described below.

With reference to the materials stated as being incorporated herein, it is to be understood that the construction of the airfoil 26 herein includes an outer body 28 that may be formed of a CMC material, and that the inner body core member 36 may be formed of a monolithic ceramic material, such as described in United States Patent Application Publication US 2004/0043889 A1. Further, as will be understood by one of ordinary skill in the art, the CMC material comprises several layers of reinforcing fibers or fabrics lying generally parallel to the outer surface 30 and disposed within a matrix material so as to provide a unitary construction.

During operation of the engine 10, the CMC outer body 28, including its constituent portions, and the ceramic inner body core member 36 each experience relative temperature differentials there between during each of three distinct stages of such operation. Those stages of operation are: a beginning stage in which the engine 16 is started from ambient conditions; a stage of substantially constant operation in which the engine 10 continues to run, albeit perhaps at differing intensities; and a termination stage in which operation of the engine 10 is stopped and the airfoil 26 is returned to ambient temperature. The relative behavior of the airfoil 26 during operation of the engine 10 in each of these stages is now discussed. In the beginning stage of engine operation, which includes the period of time during which the engine is being started from cold shutdown conditions, the engine hot gas path components including the turbine airfoils 26 are heated from room temperature to near the firing temperature of the combustor 14, which may be in excess of 1,400° C. in some embodiments. The CMC outer member 28 experiences the temperature rise first and most rapidly, with the inner core member 36 experiencing a related temperature rise somewhat later and to a lower temperature, depending upon the thermal conductivity of the materials. The resulting temperature differential between the members causes tensile stresses in which the individual layers of the CMC outer body construction 28 tend to pull away from each other and away from the bond 38 to the inner member 36. Once steady state operation has been achieved, the temperature changes in the hot combustion gas are minimized or are substantially reduced. However, there continues to be a temperature gradient existing from the outer surface 30 of the CMC material to the center of the inner core member 36. This temperature gradient is augmented by the functioning of the cooling passages 44, 48, which limit the peak temperature of the inner core member 36 to a value that is lower than would otherwise exist without the functioning of the cooling passages, since the cooling passages are disposed between the outer body CMC member and the source of core heat 54. When operation of the engine 10 is terminated, one might expect that the thermally induced stresses would decrease as the airfoil 26 returns to ambient conditions. However, when such an airfoil 26 has been operated at steady state conditions for an extended time period, such as is common for base load gas turbine power plants 10, the outer body CMC material 28 tends to relax its stress state by creep. Thus, when the engine returns to ambient shutdown conditions, the expanded outer body member 28 may tend not to shrink as much as the inner core member 36, thereby causing tensile stresses across the CMC material and the associated bond 38 to the inner member 36. Tensile stresses during such shutdown conditions following an extended operating period may be greater in magnitude than those experienced during engine start-up or steady state operation.

To specifically address an ability to decrease the level of stress that may occur in an airfoil construction, the present inventors provide a capability to deliver heat energy to the airfoil interior. Doing so allows the differential between respective sets of ranges of temperatures associable with the CMC outer body 28 and the ceramic inner body core member 36 to be controlled to achieve a reduced level of stress there between.

Figure 4:
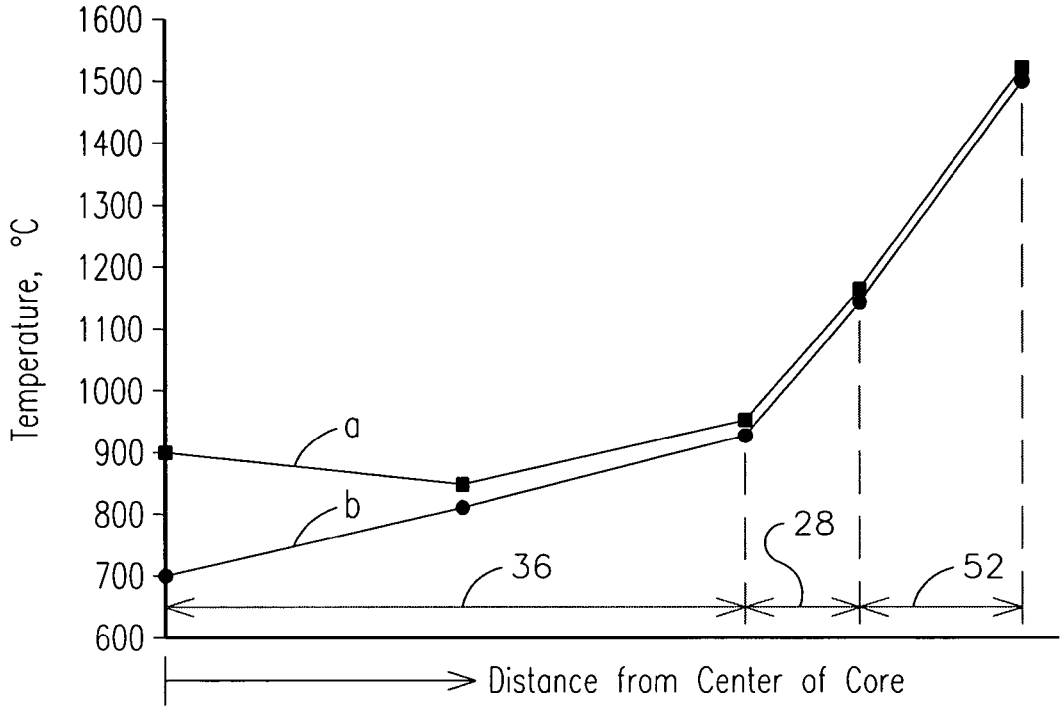
FIG. 4 is a chart illustrating the temperature affect of a heat source disposed within the core of a solid core airfoil during a state of substantially constant engine operation.

In the beginning stage of engine operation, it is contemplated that heat may optionally be introduced into the inner ceramic body core member 36 prior to and/or during initial operation of the engine, the sourcing of such heating optionally continuing during a more substantially constant operation thereof. With reference to FIG. 4, there is illustrated, in exemplary fashion, the temperature gradient existing within airfoil 26 during a state of substantially constant engine operation. FIG. 4 illustrates an exemplary temperature as a function of distance from a center of core member 36, and specifically across its outer layer of insulation 52, its CMC outer body member 28, and its ceramic inner body core member 36. Therein, it Is may be seen, with reference to the line marked "a", that the temperature differential relative to the members 36 and 28, and portions thereof, is substantially diminished upon the introduction of a heat delivery source at or near the core center when contrasted to an airfoil which does not use a heat delivery source, as represented by the line marked "b". This reduced temperature differential between the airfoil constituent members may result in a reduced differential thermal expansion there between during steady state operation, with a resultant reduction in the tensile stresses generated in the CMC material and its associated bond.

While stresses within the airfoil 26 may become relaxed through creep during substantially constant operation of the engine 10, this same relaxation may tend to increase the level of stress experienced by the airfoil 26 upon termination of such operation as the airfoil 26 then becomes exposed to room/ambient temperature. To reduce the tendency for the occurrence of this increased level of stress, heating of the interior of the airfoil 26 may be initiated or continued by causing association of a heat delivery source with the ceramic inner body core member 36 at the time of engine shutdown. As such, the airfoil 26 and in particular the core member 36 is kept heated above ambient temperature by that heat delivery source. By avoiding a drop in temperature of the core member 36 to a room temperature, peak stresses associated with shutdown conditions may be reduced.

Figure 3:
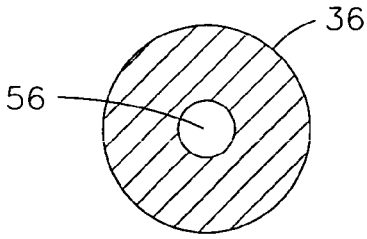

To specifically achieve the control of the temperature differential experienced across the CMC/ceramic material construction in each of the operating stages described above, it is contemplated that a heat delivery source in the form of a resistance heating element 54 may be embedded within the ceramic inner body core member 36, as shown in FIG. 2, so as to radiate heat to portions thereof. Because such heating element would have to be robust and be able to withstand vibration during engine operation, a metallic heating element may be preferred. As yet a further option in achieving the heating objectives discussed herein, it is also contemplated that the heat delivery source may include an opening 56 extending through a radial length of the ceramic inner body core member 36, as shown in FIG. 3, for the passage of a heated fluid. One may appreciate that the opening 56 illustrated in FIG. 3 may be used in lieu of or in addition to the heating element 54 as the heat source in various embodiments. The opening 56 may be operatively associated with the directing of a volume of hot combustion gas discharged by the combustor 14. Such a volume of hot combustion gas may be diverted from the outlet of combustor 14 as illustrated by conduit 55 as shown in FIG. 1, or the opening 56 may simply extend through the outermost surface 31 of the airfoil at a location of relative high pressure for passively receiving the hot combustion gas directly from the interior of the turbine 16. After flowing into the opening 56 and after being circulated within the airfoil, it is contemplated that this particular flow of hot combustion gas would then be passed through an outlet of the airfoil 26 for discharge into the turbine 16, such as through an opening of the outermost surface 31 of the airfoil at a location of relative low pressure. The rate of flow of hot combustion gas into the airfoil 26 may be controlled by the size of the relative flow paths and/or it may be actively regulated, such as with valve 57 and an associated control system (not shown).

Figure 5:
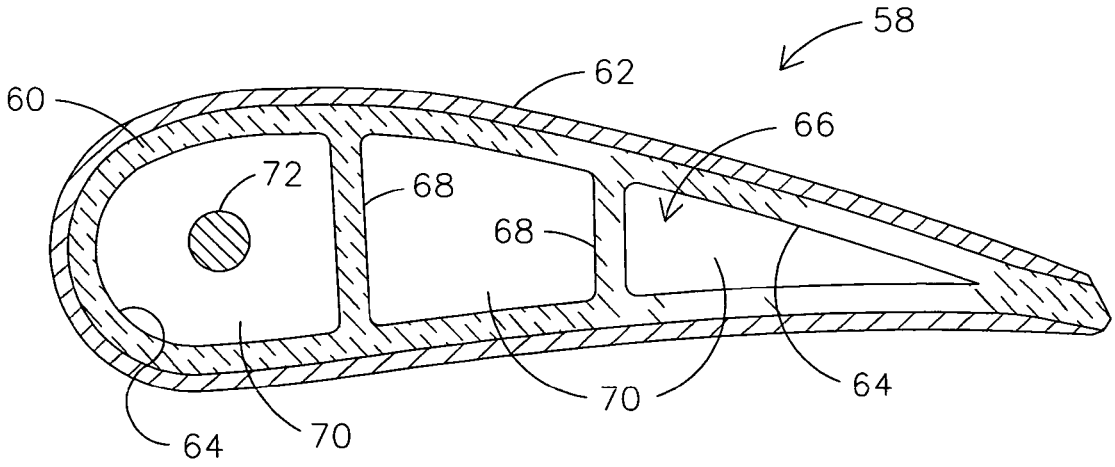
FIG. 5 is a cross-sectional view of a gas turbine airfoil including a heat source disposed within a cooling passage formed therein.

The above discussion is intended for use in an application in which the airfoil includes a ceramic inner body core member 36 that substantially fills the center of the airfoil. However, it is also contemplated that the airfoil 26 could be non-solid so as to provide a construction like that shown in FIG. 5. Therein, there is illustrated an airfoil 58 which comprises a CMC body 60 over which a layer of insulation 62 may optionally be disposed. The CMC body 60 comprises an inner wall surface portion 64 defining a core region 66 therein. The CMC body further comprises stiffening ribs 68 that may at least partially define open chambers 70 extending the radial length of the airfoil 58. A source of heat 72 is disposed within at least one of the open chambers 70. The source of heat 72 may be a heating element, a conduit for the passage of heated gas or fluid, or other source of heat known in the art. The source of heat 72 may be actively controlled such as by a controller executing programmed instructions responsive to sensed conditions of operation of the engine 10. Such sensed conditions may include but are not necessarily limited to variables such as actual and demand power level, combustion temperature, ambient temperature, airfoil temperature, etc. While chambers 70 may typically pass a cooling fluid for limiting a peak temperature of the CMC body 60, at various times during the operation of the engine 10, the heat source 72 may be operated to control a temperature differential existing across the CMC body 60. For example, in one embodiment, heat source 72 may be operated to pre-heat the CMC body 60 prior to startup of the engine 10, and/or to heat the inner wall surface 64 as the airfoil 58 is being heated by the hot combustion gas during startup of the engine, thereby limiting a temperature differential developed across the CMC material and consequently limiting peak interlaminar stresses within the material.

In a further embodiment, a heat source for controllably heating an interior of an airfoil may be disposed outside of the airfoil and within a fluid supply path that delivers fluid to the airfoil, as illustrated by flow path 74 and heat source 76 of FIG. 1. The fluid supply 74 in the illustrated embodiment directs a portion of the compressed air produced by compressor 12 to the airfoil 18. The heat source 76 in such an embodiment may be operated in conjunction with the fluid supply to control the temperature of fluid entering into the airfoil interior in order to achieve the desired interior heating affect during selected stages of operation. At other stages of operation of engine 10 when a maximum degree of cooling effect is desired, the heat source 76 may be deactivated and the fluid may function as a cooling fluid. A valve 78 may be used to regulate flow through fluid supply 74. In one embodiment the flow of hot combustion gas through conduit 55 may be merged with the flow of compressor bleed air flowing through conduit 74 with the respective flow rates being controlled to achieve a desired temperature of the fluid flowing into airfoil 18 for various modes of operation of engine 10.

While various embodiments of the present invention have been shown and described herein, it will be obvious that such embodiments are provided by way of example only. Numerous variations, changes and substitutions may be made without departing from the invention herein. For example, one may appreciate that more than one source of heat energy may be utilized, such as hot combustion gas being used during operation of the engine 10 and an electrical resistance heater being used during periods when hot combustion gas is not available. In other embodiments, steam made available from an auxiliary boiler or the steam portion of a combined cycle plant may be utilized as the source of heat energy. Accordingly, it is intended that the invention be limited only by the spirit and scope of the appended claims.

The invention claimed is:

1. A gas turbine engine with an airfoil exposed to a range of operating temperatures associated with various operations of the engine and causing thermal stresses within the airfoil, the engine comprising: a compressor producing compressed air; a combustor combusting a fuel in the compressed air to produce hot combustion gas; a turbine expanding the compressed air and producing shaft power, the turbine comprising an airfoil comprising a ceramic matrix composite member comprising an outer surface heated by the hot combustion gas; and a heat delivery source cooperable with an interior of the airfoil to affect a temperature gradient existing across the ceramic matrix composite member.

2. The engine of claim 1, wherein the heat delivery source comprises a heating element.

3. The engine of claim 2, wherein the heating element is disposed within the interior of the airfoil.

4. The engine of claim 1, wherein the heat delivery source comprises an opening within the interior of the airfoil receiving a portion of the hot combustion gas.

5. The engine of claim 1, further comprising: a conduit for delivery of a portion of the compressed air produced by the compressor to the interior of the airfoil; and the heat delivery source associated with the conduit for selectively controlling a temperature of the compressed air delivered to the interior of the airfoil.

6. The engine of claim 1, wherein the heat delivery source comprises a fluid path directing a portion of the compressed air produced by the compressor to bypass the combustor and to flow through the airfoil, and a means for heating the compressed air downstream of the compressor and upstream of the airfoil.

7. The engine of claim 1, wherein the airfoil further comprises a ceramic core member disposed within the ceramic matrix composite member; and wherein the heat delivery source is disposed within the core member.

8. The engine of claim 7, wherein the heat delivery source comprises a heating element disposed within the core member.

9. The engine of claim 7, wherein the heat delivery source comprises a fluid passageway disposed within the core member for directing a heated fluid through the core member.

10. The engine of claim 1, wherein the airfoil further comprises a ceramic core member disposed within the ceramic matrix composite member; and wherein the heat delivery source comprises an opening in the core member receiving a portion of the hot combustion gas produced by the combustor.

11. An airfoil for a gas turbine engine, the airfoil comprising; a ceramic matrix composite member comprising an outer surface defining an airfoil shape and an inner surface defining a core region; and a heat delivery source cooperable with the core region to deliver heat to the core region to affect a temperature gradient across the airfoil.

12. The airfoil of claim 11, wherein the heat delivery source comprises a heating element.

13. The airfoil of claim 12, wherein the heating element is disposed within the core region.

14. The airfoil of claim 11, wherein the heat delivery source comprises a fluid passageway through the core region that is operatively associated with a flow of heated fluid.

15. The airfoil of claim 11, further comprising: a ceramic core member disposed within the core region and bonded to at least a portion of the inner surface; and the heat delivery source being disposed within the core member.

16. The airfoil of claim 15, the heat delivery source comprising a heating element disposed in the core member.

17. The airfoil of claim 15, the heat delivery source comprising a fluid passageway formed in the core member for the passage of a heated fluid.

18. The airfoil of claim 15, further comprising a cooling channel for receiving a cooling fluid disposed between the ceramic matrix composite member and the heat delivery source.

19. A method for reducing a temperature differential among portions of an airfoil structure comprising a ceramic and ceramic matrix composite, the airfoil structure associated with alternate stages of operation of a gas turbine engine and exposed to varying thermal conditions associated with such operation, the method comprising: providing an airfoil structure comprising an ceramic matrix composite outer body defining a core region; and introducing a heat delivery source cooperable with the core region to control a temperature gradient across the airfoil structure.

20. The method of claim 19, further comprising delivering heat energy to the core region via the heat delivery source prior to exposing the outer body to an increasing temperature.

21. The method of claim 19, further comprising providing a ceramic core member within the core region, the heat delivery source cooperable with the core member to control a temperature differential between the ceramic matrix composite outer body and the ceramic core member, such control regulating thermal growth of the ceramic core member relative to the ceramic matrix composite outer body.

22. The method of claim 21, further comprising delivering heat energy to the ceramic core member via the heat delivery source prior to exposing the outer body to an increasing temperature.

23. The method of claim 21, further comprising delivering heat energy to the ceramic core member via the heat delivery source during substantially continuous exposure of the airfoil to a high temperature combustion gas.

24. The method of claim 21, further comprising delivering heat energy to the ceramic core member via the heat delivery source during substantially continuous exposure of the airfoil to an ambient room temperature in order to affect a stress level within the airfoil structure resulting from cool down from an operating temperature condition.

* * * * *